United States Patent [19]

Everhart et al.

[11] 4,260,972

[45] Apr. 7, 1981

[54] ELECTROMECHANICAL RELAY APPARATUS

[75] Inventors: Billy M. Everhart, Pataskala; Harold E. McCullough, Blacklick, both of Ohio

[73] Assignee: Bell Telephone Laboratories, Incorporated, Murray Hill, N.J.

[21] Appl. No.: 63,535

[22] Filed: Aug. 3, 1979

[51] Int. Cl.[3] ..... H01H 67/02

[52] U.S. Cl. ..... 335/129; 335/133; 335/280

[58] Field of Search ..... 335/128, 129, 133, 185, 335/196, 276, 280

[56] References Cited

U.S. PATENT DOCUMENTS

| | | | |
|---|---|---|---|
| 2,618,718 | 11/1952 | Duffing et al. | 335/280 X |
| 3,026,389 | 3/1962 | Cheronnet | 335/129 X |
| 3,066,203 | 11/1962 | Oushinsky | 335/280 X |
| 4,216,452 | 8/1980 | Arnoux et al. | 335/129 X |

FOREIGN PATENT DOCUMENTS

| | | | |
|---|---|---|---|
| 1405231 | 3/1965 | France | 335/129 |

*Primary Examiner*—George Harris
*Attorney, Agent, or Firm*—William H. Kamstra

[57] ABSTRACT

An electrical relay construction in which the function of the actuating magnetic field of operating the relay is separated completely from the function of providing contact closure force. A pair of electrically conductive, spherical bodies (18, 19) are rollably clamped by spring means (28) between a common, electrically conductive plate (20) and individual platforms (14, 15, 16) connected to the relay terminals (11, 12, 13). The common plate (20) is mounted on an actuating member (21) controlled by a solenoid (31) to roll the bodies (18, 19) between the common plate (20) and the terminal platforms (14, 15, 16) to complete the possible relay conducting paths.

15 Claims, 2 Drawing Figures

ELECTROMECHANICAL RELAY APPARATUS

TECHNICAL FIELD

This invention relates to electrical switch devices for selectively controlling the continuity of electrical circuits and particularly to electromechanically operated relays for performing this function.

BACKGROUND OF THE INVENTION

Over the years, electromechanical relays have found wide and varied application in the communications and electrical arts and have assumed a number of structural forms. In one form, such relays have typically comprised a contact spring assembly for controlling the electrical circuit or circuits in which connected, a coil for generating an operating magnetic field, and a mechanism such as an armature for controlling the spring assembly responsive to the magnetic field. In another form, the relay may comprise a pair of overlapping magnetically responsive reed springs suspended at opposite ends of an enclosing glass envelope, the latter being positioned inside and coaxial with the energizing coil. The springs are operated by the coil generated magnetic field, the flux path for which includes the springs themselves as is well known. In whatever form, electromechanical relays offer many advantages in terms of cost, reliability, and versatility, for example, in circuit applications where the highest operating speed is not a requirement despite their replacement in recent years in some electrical systems by solid state devices. Where the relays are operated in conjunction with the latter devices, which may be extremely small in size, the miniaturization of the relays is also dictated and a number of relays are known which present a minimum profile and require a minimum mounting area.

In each of the relay forms contemplated in the foregoing, the contact springs are operated by the generated magnetic field to close their contacts and, thereby, an electrical circuit, in one case, by means of an intermediate armature, in the other, directly by the field itself. At the termination of the applied field, in the normal case, the contacts are opened by spring action to break the electrical circuit in which connected. In each case, the closure force of the contact springs is directly related to the magnitude of the applied magnetic field. Accordingly, this magnitude and, hence, the power required to operate the relay, must be sufficient to provide adequate closure force. In the past, a number of problems have been encountered in connection with the fabrication and operation of relays employing contact springs which close and open for circuit control. This is particularly true of sealed reed spring relays in which an effective seal between the glass envelope, and the suspended reed contact springs is an added requirement. Spring tension and gap must also be accurately adjusted to ensure reliable operation. The art has also been long concerned with the metallurgy of the actual points of contact of the springs from the viewpoint of erosion resistance. Another concern during relay operation has been that of contact chatter or bounce causing a momentary opening of the circuit before a stable operate state is reached.

It is to the elimination of these and other problems attending the use of contact spring relays that the novel relay structure of this invention is chiefly directed. This objective is simply realized in accordance with the invention by replacing the contact springs of a relay by electrically conductive rollable bodies as circuit completion elements of the character described, for example, in U.S. Pat. No. 2,618,718 of P. Duffing et al., issued Nov. 18, 1952. The contacting arrangement there shown provides for circuit control by the contact and separation of two spherical bodies as the result of the impingement of other spherical bodies. As such, the arrangement is not readily compatible and adaptable for use with present day printed circuit applications.

SUMMARY OF THE INVENTION

The aforementioned objectives are advantageously realized and a technical advance is achieved in accordance with the principles of the invention in an electrical relay structure in which the function of the actuating magnetic field of operating the relay is separated completely from the function of providing contact closure force. A pair of electrically conductive, rollable bodies, such as spherical bodies, are maintained by spring means between a common, electrically conductive plate and individual platforms to which the relay terminals are connected. The common plate is mounted on an actuating member which is adapted for lateral movement against the action of a restoring spring by an energizing solenoid to roll the bodies between the common plate and the terminal platforms to complete the possible relay conducting paths. Thus, for example, in a transfer mode of operation, in a normal, unoperated state, a circuit path is completed by the rollable bodies between a first pair of terminals via the common plate. In its operated state, the closed circuit path is transferred by means of the rolled bodies to a second pair of terminals via the common plate as the solenoid is energized. Advantageously, the contacting force exerted on the circuit path completing bodies by the common plate is held constant whatever the operative state of the relay. Also importantly, the power required to operate the relay need only be sufficient to overcome the counteraction of the restoring spring and the small rolling friction of the spherical bodies.

BRIEF DESCRIPTION OF THE DRAWING

The objectives and features of the relay construction of the invention will be better understood from a consideration of the detailed description of the organization and operation of one illustrative embodiment thereof which follows when taken in conjunction with the accompanying drawing in which.

DETAILED DESCRIPTION

Figure 1:
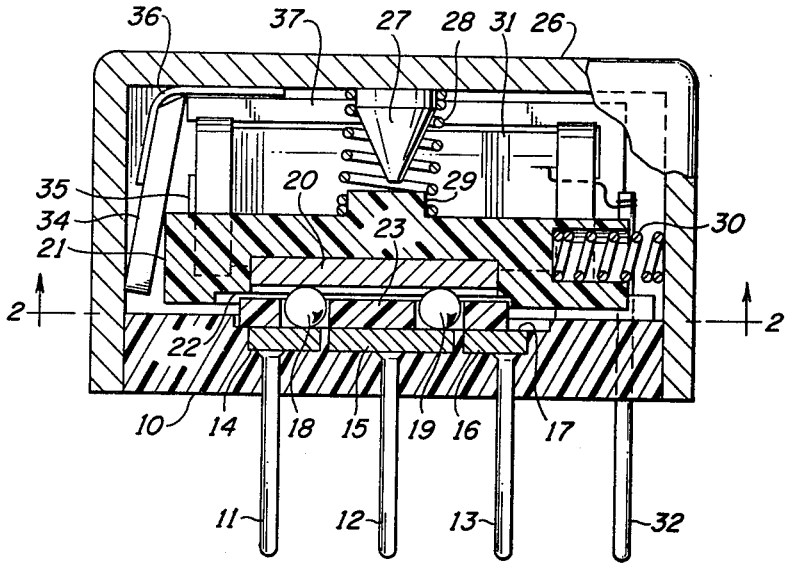
FIG. 1 depicts in enlarged, partial cross-sectional side view, the details of one-half of an illustrative relay construction according to the invention.
Figure 2:
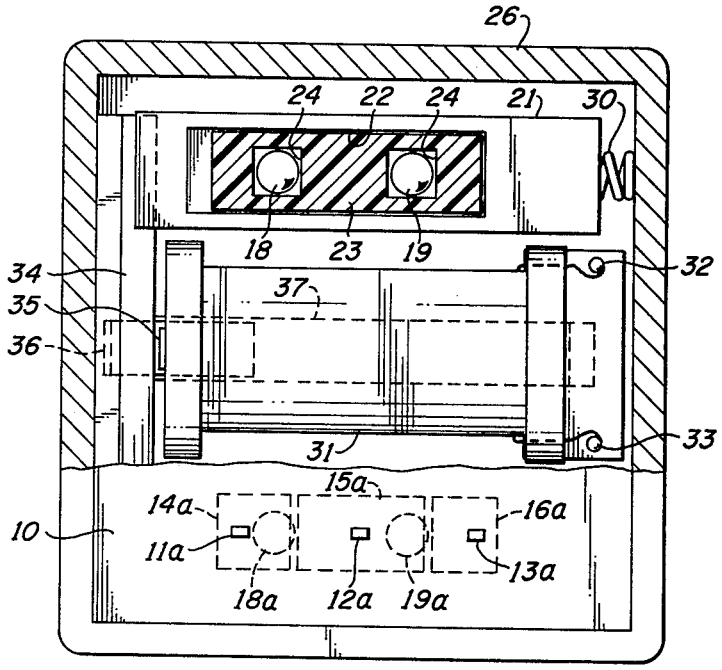
FIG. 2 is a partial cross-sectional bottom plan view of the relay construction of FIG. 1 taken along the line 2—2.

As shown best in the plan view of FIG. 2, the specific illustrative embodiment of the relay construction of the invention to be described provides for a dual set of circuit control elements, only one of which requires specific consideration for a complete understanding of the invention. The elements of each set as shown in FIG. 1 are organized with respect to a common base 10 which may be formed of any suitable electrically insulative material and which has the relay terminals extended therethrough. The set of operative elements visible in section in FIG. 1 accomplishes a transfer function between a set of terminals 11, 12, and 13, having, respectively, electrically conductive platforms 14, 15, and 16 connected thereto at one side of base 10. The surfaces of the platforms are coplanar with the surface of a slight, rectangular recess 17 formed in the latter side of base 10. Central platform 15 extends equidistant from either side of terminal 12, platforms 14 and 16 extending inwardly at each side of platform 15 from respective terminals 11 and 13. The platforms are electrically separated from each other by the insulative material of base 10. A pair of electrically conductive, rollable bodies such as the spherical bodies 18 and 19 are supported on the surfaces of recess 17 and the terminal platforms between the latter and a common electrically conductive plate 20. Plate 20 is mounted in an electrically insulative actuating member 21, its underside surface being slightly inset from a recess 22 formed in the underside of member 21. As shown in the plan view of FIG. 2, the platforms, common plate, recesses, and actuating member may conveniently be rectangular in form. Spherical bodies 18 and 19 are maintained, as shown in FIG. 1, in one operative state, in one place on platforms 14 and 15 by a floating alignment card 23 having apertures 24 in which the spherical bodies are movably fitted. Card 23 is slip fitted on one side in recess 22 of actuating member 21 and on its other side in recess 17 of base 10. Recess 22 is dimensioned to provide proper positioning of card 23 in both the operated and unoperated mode. Recess 17 is dimensioned to permit a travel of card 23 from a normal, unoperated position at the left edge (as viewed in the drawing) of recess 17 to the right edge of the latter recess.

The assembly so far described (as well as the partner assembly of the dual set of contacting elements) is contained within a cover 26 mounted in any suitable manner to base 10. The inside top of cover 26 has mounted thereon a pair of spring guide cones, one of which, cone 27 is shown in FIG. 1, each adapted to retain a coil compression spring 28 acting between cover 26 and the top surface of an actuating member 21. The latter members are correspondingly provided with a spring guide 29. The compressive force of spring 28 thus firmly and permanently clamps spherical bodies 18 and 19 between common plate 20 and the platforms of terminals 11, 12, and 13. Actuating member 21 is bored at one end to retain a restoring coil compression spring 30 which acts between member 21 and the inside of cover 26 to maintain member 21 against an armature 34 which in turn is maintained against cover 26. Bodies 18 and 19 are thus held in their proper places on platforms 14 and 15.

As more clearly shown in the plan view of FIG. 2, each of the assemblies so far described is mounted on base 10 on either side of a solenoid 31. Corresponding platforms 14*a*, 15*a*, and 16*a*, as well as spherical bodies 18*a* and 19*a*, are shown in hidden outline in FIG. 2 together with a second set of terminals 11*a*, 12*a*, and 13*a*. Solenoid 31 is energized via a pair of terminals 32 and 33 also extending through base 10 to control armature 34 by means of a polepiece 35. Armature 34 is hinged from polepiece 35 by means of a hinge spring 36 and acts simultaneously on actuating member 21 and its partner actuating member, not shown, on the other side of solenoid 31. A magnetic return path is provided by a member 37 extending to the other end of solenoid 31 which member 37 may be affixed to base 10 in any convenient manner. In its unoperated state, a pair of conducting paths are presented on either side of solenoid 31 in the relay structure so far described, an exemplary one of which may be traced in FIG. 1 as follows: from terminal 11 to terminal 12 via platform 14, spherical body 18, common plate 20, body 19, and platform 15. When solenoid 30 is energized by current applied to its terminals 32 and 33, armature 34 operates against both actuating members which, as shown in connection with member 21, are moved laterally to the right, as viewed in the drawing, against the action of the restoring springs, such as spring 30, and the slight rolling friction of the spherical bodies. As actuating member 21 is thus moved, plate 20 rolls spherical bodies 18 and 19 within apertures 24 of alignment card 23 until actuating member 21 is stopped by cover 26. Spring 28 is slightly distorted from its axis to permit the lateral movement of actuating member 21. In this operated state spherical bodies 18 and 19, for example, have now been moved to new positions on platforms 15 and 16, respectively, thereby opening the conducting path previously traced. Two new conducting paths are now completed in the relay, one of which may be traced, assuming the new positions of bodies 18 and 19, as follows: from terminal 12 to terminal 13 via platform 15, spherical body 18, common plate 20, body 19, and platform 16. Deenergization of solenoid 31 restores the actuating members to their original positions by the action of the restoring springs, as spring 30.

As mentioned hereinbefore, the illustrative relay construction of the invention described in the foregoing provides a dual transfer operation. A make-break operation or vice versa or combinations of the various operative modes are readily achievable by simply disconnecting electrically the proper one of the end terminals of the two sets of terminals. Thus, for example, by electrically disconnecting terminal 11, a make operation is accomplished between terminals 12 and 13 by the movement of actuating member 21. Also, by varying the spacing between the contact bodies in alignment card 23, contact sequencing, that is, make before break or vice versa operations may be achieved. In practice, the physical dimensions of the relay of the invention are contemplated as approximately 0.5 inch on a side by 0.28 inch in height, thus advantageously rendering the relay structure fully compatible with other printed wiring board apparatus. Manifestly, the dimensions may be further reduced by providing only a single set of circuit completion elements on only one side of solenoid 31 and such a construction is also considered as being within the scope of the invention. Although spherical bodies are contemplated in the foregoing as constituting the contacting elements, it will be appreciated that cylindrical bodies may equally serve to provide the circuit completion functions. Accordingly, what has been described in the foregoing is considered to be only one specific illustrative relay construction according to this invention. Various and numerous other arrangements may also be devised by one skilled in the art without departing from the spirit and scope of the invention as limited only as defined in the accompanying claims.

What is claimed is:

1. An electrical relay construction comprising a plurality of terminals (11, 12, 13), a solenoid (31) and an armature (34), characterized in a plurality of coplanar, electrically isolated and conductive platforms (14, 15, 16) connected respectively to the ends of said terminals (11, 12, 13), an actuating member (21) mounting an electrically conductive plate (20), and a plurality of electrically conductive, circular bodies (18, 19) clamped between said plate (20) and particular ones of said platform (14, 15), said armature (34) being operable responsive to the energization of said solenoid (31) to move said actuating member (21) to roll said bodies (18, 19) between said plate (20) and said platforms (14, 15, 16) for selectively completing conducting paths between said terminals (11, 12, 13).

2. An electrical relay construction as claimed in claim 1 also characterized in a contact force spring (28) operating against said actuating member (21) for urging said plate (20) against said circular bodies (18, 19).

3. An electrical relay construction as claimed in claim 1 or claim 2 also characterized in a floating alignment card (23) having apertures (24) for containing and spacing said circular bodies (18, 19).

4. An electrical relay construction as claimed in claim 3 also characterized in that said circular bodies (18, 19) comprise spherical bodies.

5. An electrical relay construction comprising a first and a second circuit control assembly, each including a plurality of terminals (**11, 12, 13, 11*a*, 12*a*, 13*a*), a solenoid (31) and an armature (34), characterized in that each of said first and second assembly comprises a plurality of coplanar, electrically isolated and conductive platforms (14, 15, 16, 14*a*, 15*a*, 16*a*) connected respectively to the ends of said terminals (11, 12, 13, 11*a*, 12*a*, 13*a*), an actuating member (21) mounting an electrically conductive plate (20), and a plurality of circular bodies (18, 19, 18*a*, 19*a*) clamped between said plate (20) and particular ones of said platforms (14, 15, 14*a*, 15*a*), said armature (34) being operable responsive to the energization of said solenoid (31) to move said actuating member (21) of each of said first and second assembly to roll said bodies (18, 19, 18*a*, 19*a*) between said plate (20) and said platforms (14, 15, 16, 14*a*, 15*a*, 16*a*) for selectively completing conducting paths between said terminals (11, 12, 13, 11*a*, 12*a*, 13*a***).

6. An electrical relay construction as claimed in claim 5 also characterized in that each of said assemblies also comprises a floating alignment card (23) having apertures (24) for containing and spacing said circular bodies (**18, 19, 18*a*, 19*a***).

7. An electrical relay construction as claimed in claims 5 or 6 also characterized in that said circular bodies (**18, 19, 18*a*, 19*a***) comprise spherical bodies.

8. An electrical relay construction comprising a solenoid, an armature, and a first electrical circuit completing assembly comprising a plurality of terminals, a plurality of coplanar, electrically isolated and conductive platforms connected respectively to the ends of said terminals, an electrically conductive common plate spaced apart from said platforms, a plurality of electrically conductive rollable bodies maintained between and in contact with said plate and particular ones of said platforms, and an actuating member operated by said armature responsive to the energization of said solenoid for laterally moving said plate to roll said bodies between said plate and said platforms for selectively completing conductive paths between said terminals.

9. An electrical relay construction as claimed in claim 8 also comprising a second electrical circuit completing assembly comprising a plurality of second terminals, a plurality of coplanar, electrically conductive second platforms connected respectively to the ends of said second terminals, a second electrically conductive common plate spaced apart from said platform, a second plurality of electrically conductive rollable bodies maintained between and in contact with said second plate and particular ones of said second platforms, and a second actuating member also operated by said armature responsive to the energization of said solenoid for laterally moving said plate to roll said bodies between said second plate and said second platforms for selectively completing second conducting paths between said second terminals.

10. An electrical relay construction as claimed in claim 8 also comprising a floating alignment card for each of said circuit completion assemblies, said card having apertures for containing and spacing said rollable bodies.

11. An electrical relay construction as claimed in claim 10 in which said common plates are mounted respectively on said actuating members and also comprising an enclosing cover for said relay construction, and spring means acting between said cover and said actuating members for clamping said rollable bodies between said common plates and said platforms.

12. An electrical relay construction as claimed in claim 11 in which each of said rollable bodies is spherical.

13. An electrical relay construction comprising a first, second, and third terminal, a first, second, and third coplanar electrically conductive platform connected respectively to said first, second, and third terminals, an electrically conductive common plate means spaced apart from and parallel to said platforms, a first and a second electrically conductive spherical body maintained between and in contact with said common plate means and said first and second platforms, respectively, an alignment card having apertures for containing and spacing said spherical bodies, a solenoid, and armature means operated responsive to the energization of said solenoid for laterally moving said plate means to roll said first and second spherical bodies between said plate means and said second and third platforms, respectively.

14. An electrical relay construction as claimed in claim 13 also comprising an enclosing cover and spring means acting between said cover and said common plate means for clamping said spherical bodies between said plate means and said platforms.

15. An electrical relay construction as claimed in claim 14 also comprising second spring means acting between said cover and said common plate means for laterally restoring said last-mentioned means when said solenoid is deenergized.

* * * * *